US008681494B2

(12) United States Patent
Hirota

(10) Patent No.: US 8,681,494 B2
(45) Date of Patent: Mar. 25, 2014

(54) FAN FASTENING DEVICE

(75) Inventor: Hideyuki Hirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 408 days.

(21) Appl. No.: 13/058,509

(22) PCT Filed: Jul. 23, 2009

(86) PCT No.: PCT/JP2009/003469

§ 371 (c)(1),
(2), (4) Date: Feb. 10, 2011

(87) PCT Pub. No.: WO2010/044181

PCT Pub. Date: Apr. 22, 2010

(65) Prior Publication Data

US 2011/0156554 A1 Jun. 30, 2011

(30) Foreign Application Priority Data

Oct. 14, 2008 (JP) ..... 2008-265255

(51) Int. Cl.
*H05K 7/20* (2006.01)

(52) U.S. Cl.
USPC ..... 361/695

(58) Field of Classification Search
USPC ..... 415/213.1, 214.1; 361/695
See application file for complete search history.

(56) References Cited

U.S. PATENT DOCUMENTS

| | | | | |
|---|---|---|---|---|
| 2,999,313 | A * | 9/1961 | Emmert | 83/611 |
| 5,969,941 | A | 10/1999 | Cho | |
| 6,826,048 | B1 * | 11/2004 | Dean et al. | 361/695 |
| 6,921,328 | B1 * | 7/2005 | Nohara et al. | 454/184 |
| 2003/0039546 | A1 | 2/2003 | Liu | |
| 2005/0168944 | A1 | 8/2005 | Chen | |
| 2006/0237165 | A1 * | 10/2006 | Mizuguchi | 165/59 |
| 2007/0286725 | A1 * | 12/2007 | Su | 415/213.1 |

FOREIGN PATENT DOCUMENTS

| | | | |
|---|---|---|---|
| JP | 64-31960 | | 2/1989 |
| JP | 1-232200 | A | 9/1989 |
| JP | 1-148545 | U | 10/1989 |
| JP | 1-160893 | A | 11/1989 |
| JP | 2-78798 | U | 6/1990 |
| JP | 3-6099 | | 1/1991 |
| JP | 3-30600 | U | 3/1991 |
| JP | 3-145600 | A | 6/1991 |
| JP | 4-30300 | U | 3/1992 |
| JP | 10-240385 | A | 9/1998 |
| JP | 11-132199 | A | 5/1999 |

* cited by examiner

*Primary Examiner* — Nathaniel Wiehe
*Assistant Examiner* — Eldon Brockman
(74) *Attorney, Agent, or Firm* — Birch, Stewart, Kolasch & Birch, LLP

(57) ABSTRACT

A heat dissipating fan is housed in the opening of a chassis in the direction of thickness of the fan; a plurality of holding portions provided on the edges of the opening support the heat dissipating fan, parallel to the surface of the chassis; a plurality of elastic members provided on the two adjoining edges of the opening, respectively, urge the heat dissipating fan in the respective directions of the opposed edges of the opening to position the fan; and further a holder is provided with a plurality of elastic portions around ventilating openings corresponding to a blower window of the heat dissipating fan, and the elastic portions are abutted against the top surface of the peripheral portion of an outer casing of the heat dissipating fan to urge the heat dissipating fan perpendicularly to the face of the chassis.

4 Claims, 6 Drawing Sheets

( a )

( b )

FAN FASTENING DEVICE

TECHNICAL FIELD

The present invention relates to a fan fastening device for fastening a heat dissipating fan that ventilates the interior of an electronics equipment to a chassis.

BACKGROUND ART

Integrated circuits are employed for a large number of electronic circuits in today's electronics for the purpose of downsizing; however, a circuit, a disk drive, and the like are housed within a narrow space thereof. Thus, heat from an element generating a large amount of heat such as a CPU (central processor unit) is accumulated within an electronics equipment, which can become a factor causing a CPU itself and other integrated circuits to malfunction. For this reason, a fan for dissipating heat accumulated in the interior thereof to the exterior is installed in a large number of electronics equipments. In general, a variety of commercially available large or small fans, which are reduced in weight, are used as heat dissipating fans, and electronics makers install those fans in the electronics equipments in consideration of the dissipating efficiency, space-saving efficiency, installing method, cost thereof, and so on.

For a conventional method of fastening a heat dissipating fan, there is a technique such that one method includes the steps of upright standing a heat dissipating fan; then positioning the fan by inserting the lower portion of the fan in a rectangular groove prepared on the surface of a chassis; resiliently holding an upper shoulder of the heat dissipating fan with a fixing member; and fixing with one screw an extended lower end of the fixing member extending down along one of the sides of the heat dissipating fan to a fixing boss standing upright from the chassis (for example, see Patent Document 1). In this technique, it is said that the need for fixing a heat dissipating fan with many screws is eliminated, which results in simplifying the assembly procedure thereof; thus, when the technique is applied to an apparatus having no room in assembly space, the installation of the heat dissipating fan can be easily performed.

The technique of the aforementioned Patent Document 1 is suitable for fastening a heat dissipating fan to the surface of a chassis with the fan upright stood; however, the technique cannot be applied when an electronics equipment is of a thin type. When an electronics equipment is of a thin type, a heat dissipating fan is typically installed parallel to the surface of a chassis through which a ventilating window is prepared. In this case, conventionally, a heat dissipating fan is secured to the surface of the chassis by directly screwing peripheral four places thereof, or a holder having a shape for holding the outer periphery of the section of the fan that is out of contact with the surface of the chassis is employed to screw a fringe member of the holder to the chassis, thus securing the heat dissipating fan thereto.

PRIOR ART DOCUMENTS

Patent Documents

Patent Document 1: JP-A-1998-240385 (FIG. 1)

SUMMARY OF THE INVENTION

In the fastening technique of the heat dissipating fan disclosed in Patent Document 1 as described above, the fan is stood upright, which is unsuitable for a thin electronics equipment. Further, due to the fastening method with a single screw, the screw can easily loosen because of rotational vibrations of a fan with years of use, and moreover the vibrations can produce abnormal noises, which requires separate vibration absorbing measures. Also, the fastening technique cannot sufficiently meet an equipment susceptible to external vibrations, such as a vehicle navigation apparatus.

Further, in the case of the method of securing the heat dissipating fan by directly screwing the four peripheral places thereof thereto, the screws have to be passed through the specified fastening holes of the heat dissipating fan. However, when threaded holes corresponding to the specified fastening holes thereof cannot be prepared on the side of the chassis, fastening with all screws cannot be carried out. On the other hand, in the case of the method of fixing the fan through the holder, the holder can be appropriately provided with a screw insertion hole corresponding to a threaded hole on the side of the chassis; however, a heat dissipating fan varies in external size according to a production lot, and thus the fan having a smaller size can develop the chatter between the fan and the holder, while the fan having a larger size is inadaptable to the holder; these are drawbacks. Furthermore, in the method of directly screwing the fan and the method of screwing the fan through the holder, the screw can easily loosen because of vibrations caused by the rotation of the fan, and abnormal noises can be generated by the vibrations. Therefore, the use of screws with a spring washer and the addition of vibration absorbing components are required. Further, the heat dissipating fan is to be projected from the surface of the chassis by the thickness of the fan, which can hinder slimness of electronics equipments.

The present invention has been made to solve the above-mentioned problems, and an object of the present invention is to provide a fan fastening device having a structure where variations in size of a heat dissipating fan and vibrations thereof can be absorbed.

A fan fastening device according to the present invention is arranged such that a heat dissipating fan is housed in an opening of a chassis in the direction of thickness of the fan, a plurality of holding portions provided on the edges of the opening support the heat dissipating fan, parallel to the surface of the chassis, elastic members provided on two adjoining edges of the opening, respectively, urge the heat dissipating fan in the respective directions of the opposed edges of the opening to position the fan, a holder is provided with a plurality of elastic portions around ventilating openings corresponding to blower windows of the heat dissipating fan, and the elastic portions are abutted against the top surface of the peripheral portion of an outer casing of the heat dissipating fan to urge the heat dissipating fan in a direction perpendicular to the surface of the chassis.

According to the present invention, it is possible to fix the heat dissipating fan to the chassis with resiliency. Particularly, the elastic members of the chassis and the elastic portion of the holder absorb the variations of the heat dissipating fan in dimension, thus enabling the vibrations of the heat dissipating fan to be cushioned and the loosening of the screw to be restricted. As a result, the heat dissipating fan can be also restrained from generating abnormal noise due to the vibrations thereof. Further, the heat dissipating fan is disposed so as to be embedded in the chassis, which can also contribute to slimness of the appliance.

BEST MODE FOR CARRYING OUT THE INVENTION

Embodiments of the present invention will now be described with reference to the accompanying drawings in order to explain the present invention in more detail.

First Embodiment

Figure 1:
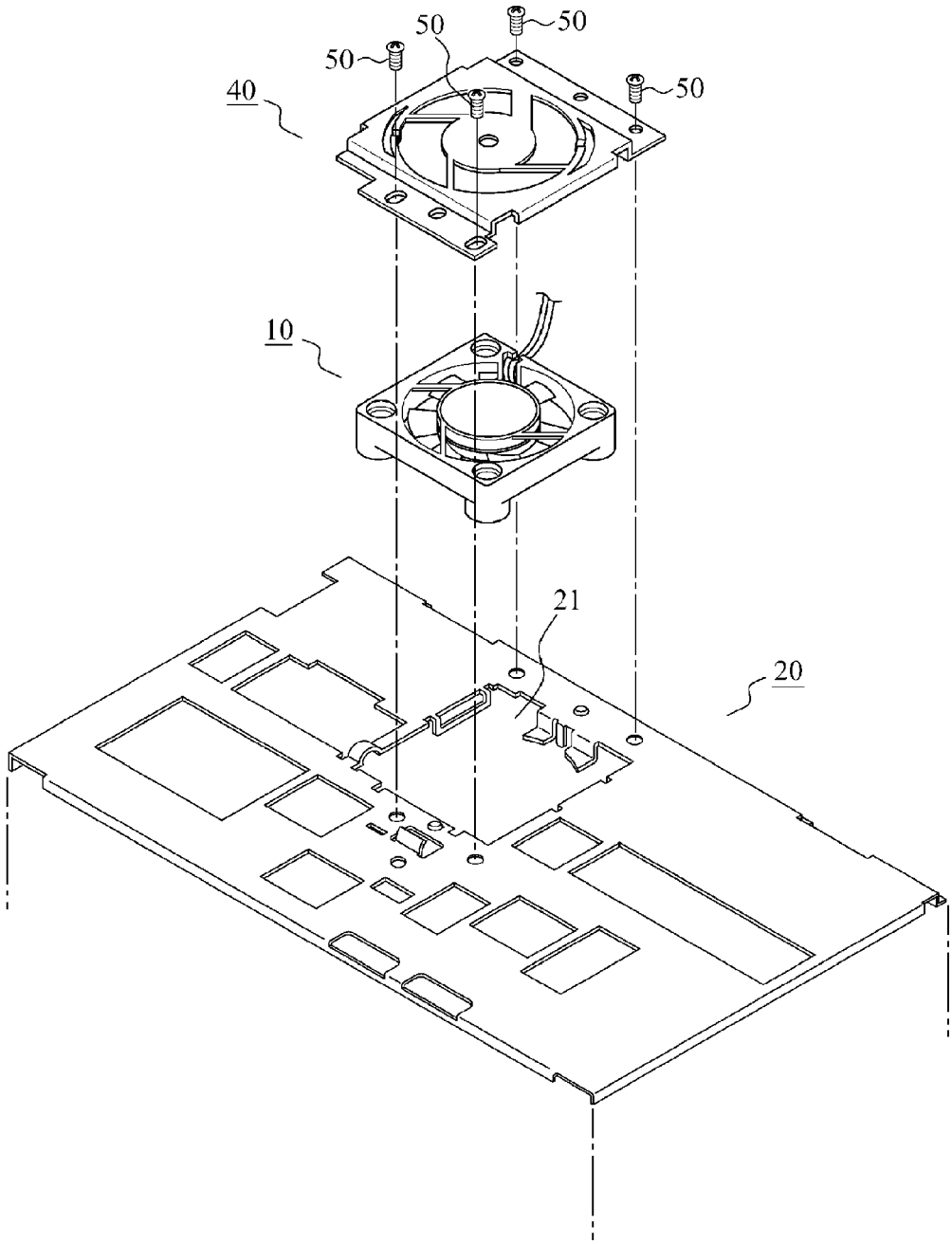
FIG. 1 is an assembly view of a fan fastening device in accordance with a first embodiment of the present invention.

FIG. 1 is an assembly and exploded view of a fan fastening device in accordance with a first embodiment of the present invention.

During assembly, a heat dissipating fan 10 is housed in an opening 21 of a chassis 20 and fitted therein, a holder 40 is placed over the upper portion of the heat dissipating fan 10, and the periphery of the holder 40 is fixed to the chassis 20 with screws 50. In this case, the chassis 20 and the holder 40 each having a structure as discussed hereinbelow can bring about a state where the heat dissipating fan 10 is securely mounted therein.

First, a structure of the heat dissipating fan 10 will be discussed by referring to FIG. 2 and FIG. 3.

Though the heat dissipating fan 10 employed herein is a commercially available standard product, even different manufacturers can provide the fan having a substantially similar structure. The heat dissipating fan 10 is molded from plastic except parts related to the rotation of a motor (not shown) has a substantially square face, and further has an outer casing 11 of a thin type in the direction of thickness thereof. A motor unit 12 and a rotor 13 attached around the rotating shaft of a motor (not shown) are disposed at the center of the outer casing 11 shaped like a square. A plurality of blades 14 rotating with the rotor 13 are attached on the outer periphery of the rotor 13. The motor unit 12 is supported by four support branches 15 bridged between the motor unit and a peripheral portion 11*a* of the outer casing 11, and a motor-driving feeder 16 is introduced therein by using one of the support branches 15. A portion that is enclosed by the motor unit 12, the peripheral portion 11*a* of the outer casing 11, and the support branches 15 forms a plurality of blower windows 18 each having a sickle shape for passing an air stream produced by the rotation of the blades 14. Further, screw passing holes 17 for original mounting are provided at four corners of the square shape of the outer casing 11. Here, the support branches 15 are provided only on one side of the outer casing 11 (the side in FIG. 2), and support the motor unit 12 by their relatively thin plates made of plastic. Thus, it is undesirable to exert force vertical to the motor unit 12 thereon.

Next, a structure of the chassis 20 will be discussed with reference to FIG. 4, FIG. 5, and FIG. 6.

Figure 4:
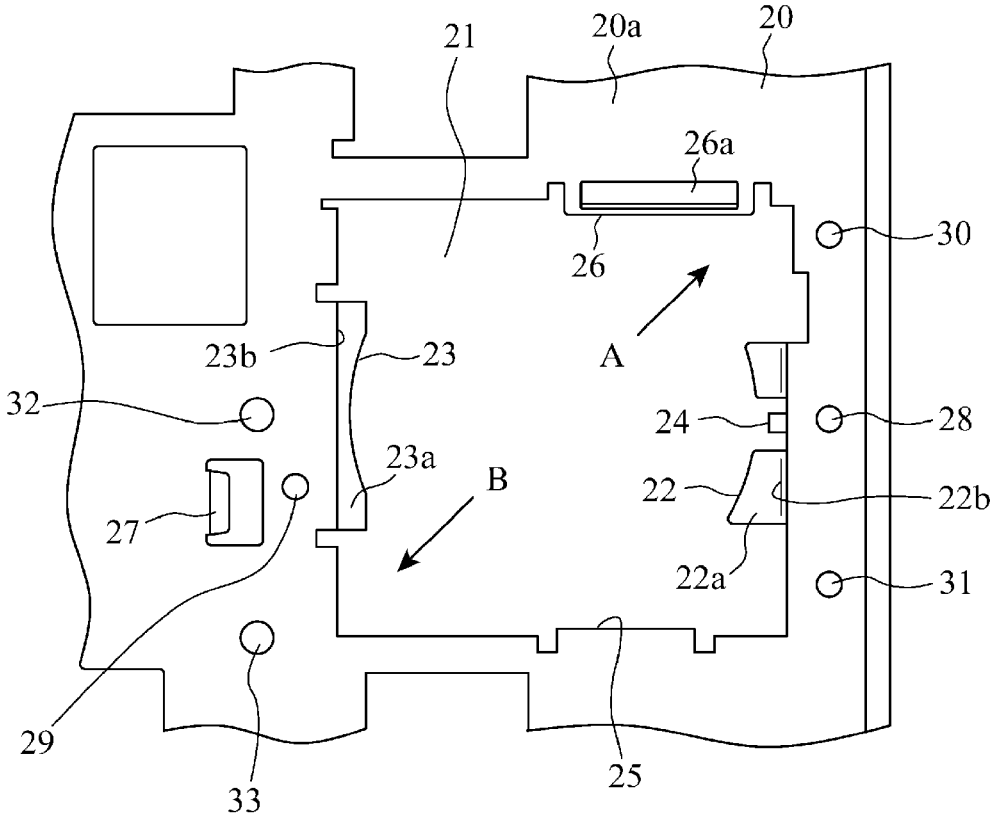
FIG. 4 is a partial plan view showing a structure of a chassis in accordance with the first embodiment.
Figure 5:
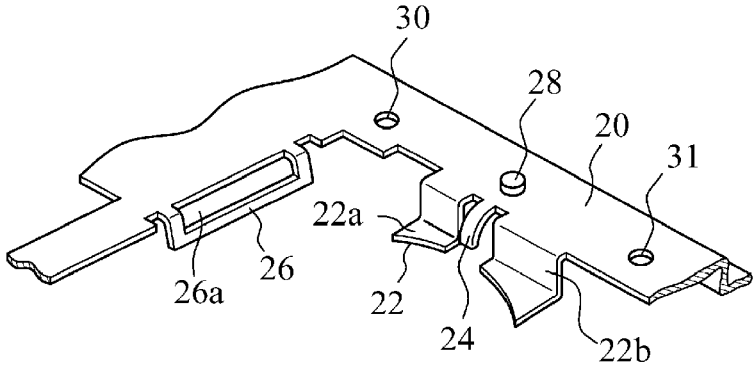
FIG. 5 is a perspective view with portions broken away showing the structure of the chassis in accordance with the first embodiment.
Figure 5:
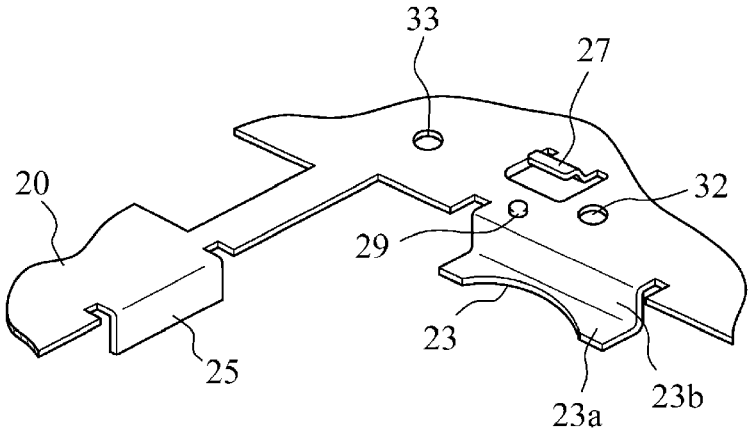

FIG. 4 shows only the main parts of the chassis 20 for mounting the heat dissipating fan 10 therein, and the chassis 20 includes the opening 21 for housing and mounting the heat dissipating fan 10 therein in the direction of thickness of the fan. The opening 21 has a substantially square shape somewhat larger than the square shape of the outer casing 11 of the heat dissipating fan 10. The opening 21, as shown in FIG. 5, has provided on a pair of opposed edges thereof, vertical walls 22*b*, 23*b* which are molded integral with the chassis 20 and extend vertically with respect to a chassis front 20*a* toward the back side thereof, and L-section holding portions 22, 23 having support members 22*a*, 23*a* extending parallel to the chassis front 20*a* inwardly in the opening 21. Those holding portions 22, 23 support the heat dissipating fan 10 housed in the opening 21 by the support members 22*a*, 23*a* around the periphery at the bottom of the fan such that the fan is parallel to the surface of the chassis, and position the heat dissipating fan 10 in the direction of thickness of the fan. Further, the support members 22*a*, 23*a* are provided with fringes each having an appropriate curvature so as not to come in contact with the blades 14 of the heat dissipating fan 10 in a state where the support members support the heat dissipating fan 10. In this example, it is arranged that the heat dissipating fan 10 is not supported by the support members 22*a*, 23*a* in a manner where the entire outer casing 11 in the direction of thickness thereof is housed below the surface of the chassis, but is supported with a portion of the outer casing projected upwardly from the surface of the chassis.

Moreover, the edge where the holding portion 22 is disposed is provided with an elastic member 24 that is molded integral with the chassis 20 and has a shape extending from the chassis front 20*a* toward the back side thereof and inclingly extending inwardly in the opening 21. The elastic member 24 abuts against one side of the heat dissipating fan 10 housed in the opening 21 at the tip thereof, and urges the heat dissipating fan 10 toward the vertical wall 23*b* of the holding portion 23 opposite the member. In such a way, the heat dissipating fan 10 is positioned in one direction parallel to the surface of the chassis. In this connection, in the example, the elastic member 24 is arranged at the midpoint between the divided holding portions 22; however, the elastic member does not always require such an arrangement, and the member can be arranged on both sides of the holding portion 22 so as not to be in an overlapping relation therewith.

One of the edges adjoining the edge provided with the holding portion 22 of the opening 21 is provided with a wall member 25 that is molded integral with the chassis 20 and extends vertically with respect to the chassis front 20*a* toward the back side thereof. Further, the other of the adjoining edges is provided with an elastic member 26 that is molded integral with the chassis 20 and has a shape extending from the chassis front 20*a* toward the back side thereof and inclingly extending inwardly in the opening 21. The elastic member 26 has a cut-out window 26*a* formed in a plate having a longitudinal part, which is the extension of the chassis 20, and is arranged such that portions working as both arms thereof have resiliency. The elastic member 26 abuts against one of the sides of the heat dissipating fan 10 housed in the opening 21 to urge the heat dissipating fan 10 toward the wall member 25 located in the opposing position. In such a way, the heat dissipating fan 10 is positioned in the direction parallel to the surface of the chassis and perpendicular to the vertical wall 23*b*.

Moreover, the chassis front 20*a* on the side of the holding portions 22, 23 of the chassis 20 is provided with a lock section 27, round bosses 28, 29, and screw holes 30 to 33 for securing the holder 40 thereto. The lock section 27 is a portion having a reverse-L section, which is formed by cutting and turning a portion of the surface on the side of the holding portion 23, has a space in a dimension such that the plate thickness of the holder 40 can be received between the lock section and the chassis front 20*a*, and locks a mounting member of the holder 40 upon mounting of the holder 40 to prevent the holder from being separated from the surface of the chassis.

Figure 6:
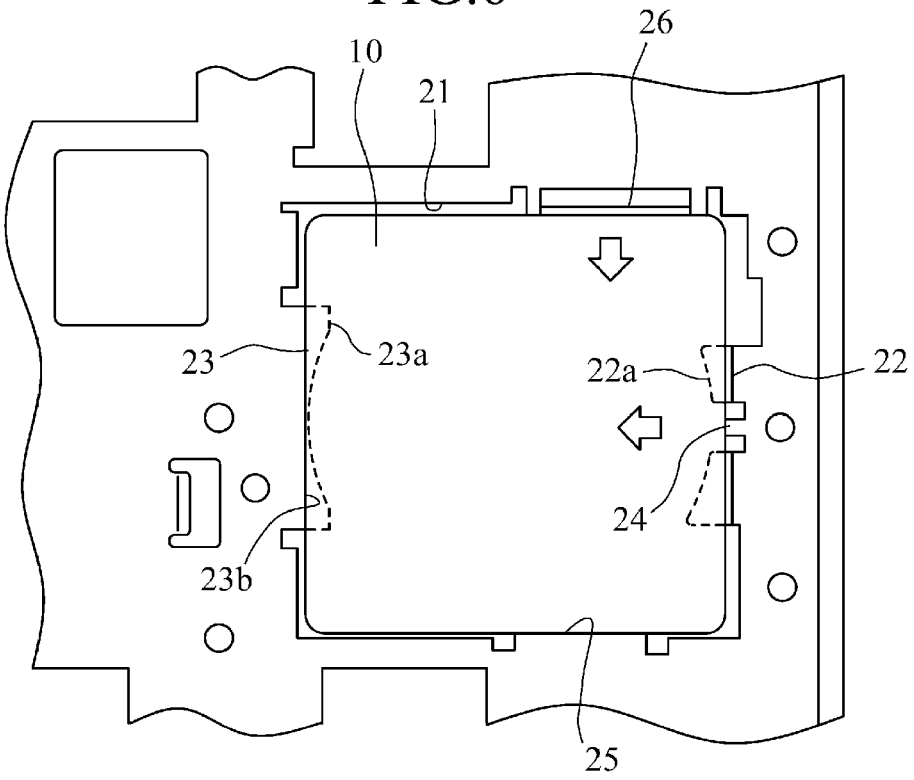
FIG. 6 is a plan view showing a state where the heat dissipating fan in accordance with the first embodiment is inserted in an opening of the chassis and mounted therein.

FIG. 6 shows a state where the heat dissipating fan 10 is housed and fitted in the opening 21. The heat dissipating fan 10 is placed on the support member 22*a* of the holding portion 22 and the support member 23*a* of the holding portion 23, is urged toward the vertical wall 23*b* of the holding portion 23 by the elastic member 24, and is pressed toward the wall member 25 by the elastic member 26 to be positioned and held by two directions at right angles to each other.

Figure 7:
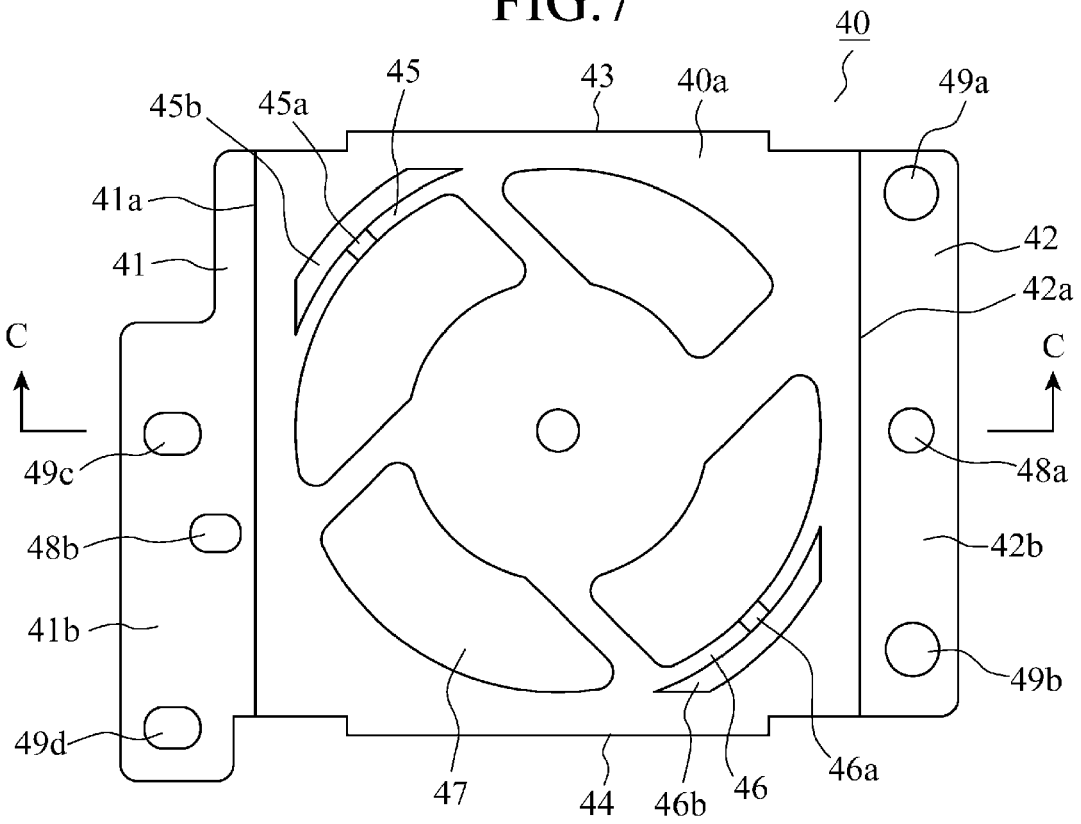
FIG. 7 is a plan view showing a structure of a holder in accordance with the first embodiment.
Figure 8:
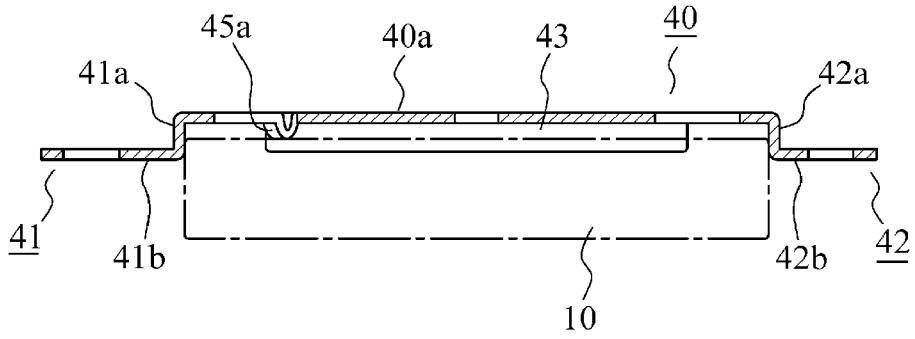
FIG. 8 is a sectional view showing the structure of the holder in accordance with the first embodiment.
Figure 9:
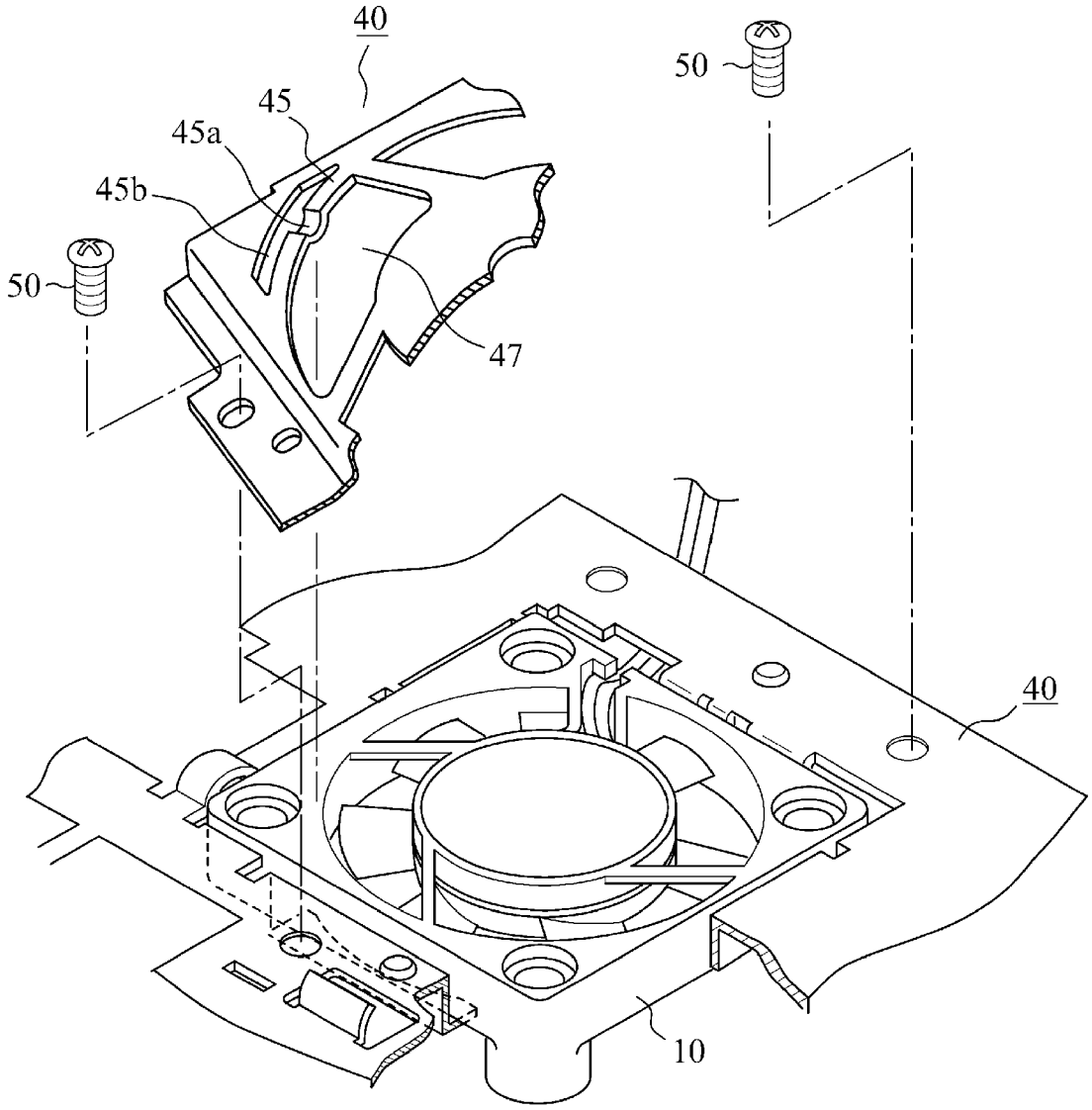
FIG. 9 is a perspective view with a portion broken away showing the function of an elastic bridge of the holder in accordance with the first embodiment.

Next, a description will be given of a structure of the holder 40 with reference to FIG. 7, FIG. 8, and FIG. 9.

The holder 40 is molded from sheet metal, and includes a substantially square top plate 40*a*. Four sickle-shaped ventilating openings 47 are formed in the top plate 40*a* corresponding to the blower windows 18 through the top surface of the heat dissipating fan 10 as shown in FIG. 2. Also, slits 45*b*, 46*b* are provided in the top plate 40*a* substantially parallel to the curved edges of the ventilating openings 47 located in the diagonal positions, while band-shaped elastic bridges (elastic portions) 45, 46 are formed between the slits 45*b*, 46*b*, and the ventilating openings 47. The elastic bridges 45, 46 are formed in the positions opposed to the peripheral portion 11*a* of the outer casing 11 of the heat dissipating fan 10 as shown in FIG. 2. Then, projections 45*a*, 46*a* downwardly pointed are formed in the midpoints of the elastic bridges 45, 46. The elastic bridges 45, 46 abut the projections 45*a*, 46*a* against the upper surface of the peripheral portion 11*a* of the outer casing 11 of the heat dissipating fan 10 housed in the opening 21 of the chassis to urge the heat dissipating fan 10 toward the support members 22*a*, 23*a* of the holding portions 22, 23. In this connection, in this example two elastic bridges are provided; however, three or four elastic bridges may be provided instead.

Further, vertical wall surfaces 41*a*, 42*a* extending downwardly with respect to the surface of the top plate, and L-section mounting components 41, 42 consisting of mounting flanges 41*b*, 42*b* parallel to the surface of the top plate are formed on a pair of opposed outer edges of the top plate 40*a*. The wall surfaces 41*a*, 42*a* of the mounting components 41, 42 each have a dimension to allow for the portion of the heat dissipating fan 10 that projects upwardly from the surface of the chassis. Further, boss holes 48*a*, 48*b* into which the round bosses 28, 29 of the chassis 20 are inserted, and screw passing hole 49*a* to 49*d* into which the screws in mesh with the screw holes 30 to 33 of the chassis 20 are inserted are provided in the mounting flanges 41*b*, 42*b* of the mounting components 41, 42. Furthermore, another pair of opposed outer edges, which are in an adjoining relation with the pair of outer edges of the top plate 40*a*, are provided with wall members 43, 44 extending perpendicular to the surface of the top plate. The wall surfaces 41*a*, 42*a* and the wall members 43, 44 are formed so as to enclose the outer peripheral portion of the outer casing 11 of the heat dissipating fan 10, which is located above the surface of the chassis.

Next, a description will be given of an operation for fixing the heat dissipating fan 10 in the chassis 20.

Figure 2:
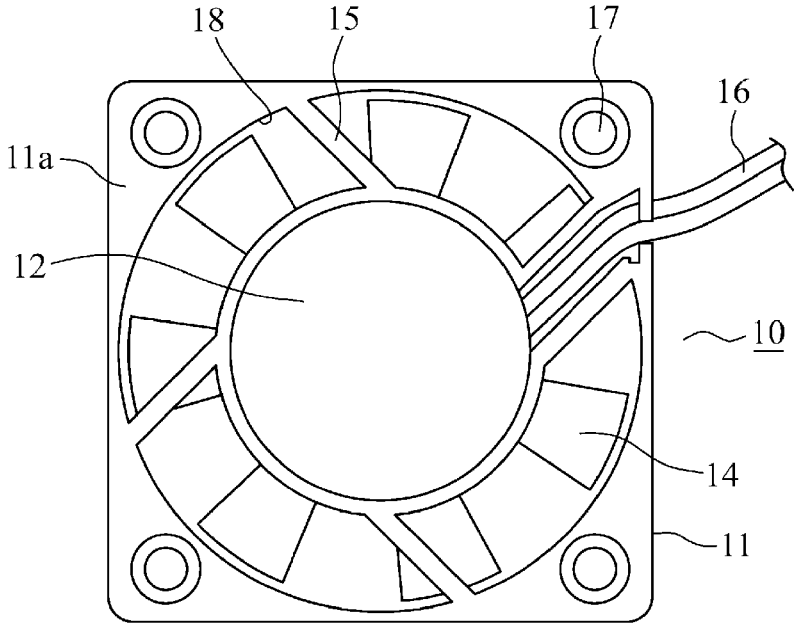
FIG. 2 is a plan view showing a structure of the heat dissipating fan in accordance with the first embodiment.
Figure 3:
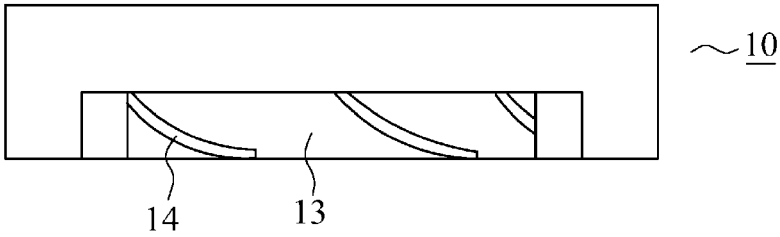
FIG. 3 is a front view showing the structure of the heat dissipating fan in accordance with the first embodiment.

First, the heat dissipating fan 10 is housed in the opening 21 of the chassis 20 with the side as shown in FIG. 2 turned upward. The housed heat dissipating fan 10 is supported in the lower portion thereof by the support members 22*a*, 23*a* of the holding portions 22, 23, which are provided in an opposing relation to each other around the inner circumference of the opening 21, to thereby position the heat dissipating fan in the vertical direction with respect to the chassis front 20*a*. Under such a condition, the heat dissipating fan 10 is urged toward the vertical wall 23*b* of the holding portion 23 by the elastic member 24 incliningly extending inwardly from the edge where the support member 22*a* of the opening 21 is provided. Further, simultaneously, the elastic member 26 having the cut-out window 26*a* provided on another edge of the opening 21 abuts against a side of the heat dissipating fan 10 to urge the heat dissipating fan 10 toward the wall member 25 positioned opposite the elastic member 26. In such a way, as shown in FIG. 6, the heat dissipating fan 10 is abutted against the vertical wall 23*b* and the wall member 25 perpendicular to the vertical wall by the urging force of the elastic members 24, 26 to be positioned therein.

After the heat dissipating fan 10 is housed and fitted in the opening 21 of the chassis 20 as discussed above, the holder 40 is placed over the heat dissipating fan 10. In this case, while the mounting flange 41*b* of the mounting component 41 of the holder 40 is fit in the lock section 27 provided on the chassis 20, the round bosses 28, 29 are aligned with the boss holes 48*a*, 48*b* of the holder 40 and inserted therein, and thereby the holder 40 is positioned with respect to the chassis 20. Further, the screws 50 are meshed with threaded holes 30 to 33 through screw insertion holes 49*a* to 49*d* corresponding to the threaded holes to fasten the holder 40 to the chassis 20. As shown in FIG. 9, under such condition, the projections 45*a*, 46*a* of the elastic bridges 45, 46 provided on the top plate 40*a* of the holder 40 can abut against a peripheral portion 11*a* of the top surface of the outer casing 11 of the heat dissipating fan 10; thus, an urging force pushing down the fan toward the support members 22*a*, 23*a* of the chassis 20 is given on the heat dissipating fan 10. Thus, the heat dissipating fan 10 is positioned in the vertical direction.

In such a way, the heat dissipating fan 10 is fixed to the chassis 20 with resiliency.

Moreover, when the outer casings 11 of the heat dissipating fan 10 vary in size, the chatter caused thereby is absorbed by the elastic members 24, 26 provided on the chassis 20 and the elastic bridges 45, 46 provided on the holder 40. Further, the heat dissipating fan 10 is arranged with a portion of the fan projected above the chassis front 20*a* to thereby circumvent the need to occupy the space on the chassis front 20*a*, which can also have an advantageous effect on downsizing of the equipment. Furthermore, in a case where there is sufficient room in the lower space of the chassis 20, the whole thickness of the heat dissipating fan 10 may be housed inside the chassis front 20*a*; in that case, the holder 40 has only to be provided with a plate.

In this connection, in the above-discussed example, the edges of the chassis opposite to the elastic members 24, 26 provided in the chassis 20 have provided thereon the vertical wall 23*b* and the wall member 25 against which the heat dissipating fan 10 is abutted, respectively, thus positioning the fan in two directions parallel to the surface of the chassis; however, if the adjoining edges of the chassis 20 themselves extend in directions at right angles, directly abutting the heat dissipating fan 10 against the corresponding edges of the chassis 20 can position the fan. In that case, both or one of the vertical wall 23*b* and the wall member 25 does can be eliminated.

As discussed above, in accordance with the first embodiment, the chassis 20 includes by molding in one piece: the substantially square opening 21 for housing the heat dissipating fan 10 in the direction of thickness with fitting the substantially square face of the fan; the plurality of holding portions 22, 23, provided on at least a pair of opposed edges of the opening 21, for supporting the housed heat dissipating fan 10 in the peripheral portion at the bottom of the fan to be parallel to the surface of the chassis; and the plurality of elastic members 24, 26, provided on the pair of adjoining edges of the opening 21, for urging the heat dissipating fan 10 supported by the holding portions 22, 23 in the directions of the opposed edges of the opening 21 to position the fan, and further, the holder 40 includes by molding in one piece: the ventilating openings 47 corresponding to the blower windows 18 of the housed heat dissipating fan 10; and the plurality of elastic bridges 45, 46 which abut against the peripheral potion 11*a* on the top surface of the outer casing of the housed heat dissipating fan 10 to urge the heat dissipating fan 10 perpendicularly with respect to the surface of the chassis and in the direction of the support faces (the faces of the support members 22*a*, 23*a*) of the holding portions 22, 23. Therefore, the heat dissipating fan 10 is urged by the elastic members 24, 26 of the chassis 20 in the directions of the opposed edges in the opening, to thereby position the fan, and further the heat dissipating fan 10 is urged in the direction perpendicular to the surface of the chassis by the elastic bridges (elastic portions) 45, 46 of the holder 40. Thus, it is possible to fasten the heat dissipating fan 10 in elastic engagement with the chassis 20. Particularly, it is possible to absorb the variations of the outer casing 11 of the heat dissipating fan 10 in dimension by the elastic members 24, 26 and the elastic bridges 45, 46, and further it is possible to cushion the vibrations of the heat dissipating fan 10 to thereby restrain the screws 50 from loosening. As a result, the heat dissipating fan 10 can be restrained from generating abnormal noise due to the vibrations thereof. Furthermore, the heat dissipating fan 10 is disposed so as to be embedded in the chassis 20, which can also contributes to slimness of the appliance.

INDUSTRIAL APPLICABILITY

According to the present invention, the heat dissipating fan 10 is fastened to the chassis with resiliency, thus restraining generation of abnormal noise from the heat dissipating fan to be restrained from generating abnormal noise due to the vibrations thereof. Therefore, the fan fastening device according to the present invention is suitable for use in a fan fastening device for fastening a heat dissipating fan for ventilating the interior of an electronics equipment to a chassis, or the like.

The invention claimed is:

1. A fan fastening device for fastening a heat dissipating fan having a small-thickness outer casing with a substantially square face, comprising:

a chassis to which the heat dissipating fan is fastened to with screws; and a holder which is used for fastening the heat dissipating fan to the chassis, wherein the chassis includes by molding in one piece:

a substantially square opening for housing the heat dissipating fan in the direction of thickness with fitting the substantially square face therein;

a plurality of holding portions, provided on at least a pair of opposed edges of the opening, for supporting the housed heat dissipating fan in the peripheral portion at the bottom thereof with respective supporting faces which are parallel to the surface of the chassis; and a plurality of elastic members, provided on a pair of adjoining edges of the opening, for urging the heat dissipating fan supported by the holding portions in the directions of the opposed edges of the opening to position the fan, and wherein the holder includes by molding in one piece:

a ventilating opening corresponding to a blower window of the housed heat dissipating fan; and a plurality of elastic portions, abutting against the peripheral portion on the top surface of the outer casing of the housed heat dissipating fan, for urging the heat dissipating fan perpendicularly with respect to the surface of the chassis and in the direction of the support faces of the holding portions.

2. The fan fastening device according to claim 1, wherein one of the elastic members is provided on a first edge of the opening where one of the holding portions is provided, and urges the heat dissipating fan to abut the fan against a vertical wall of the other of the holding portions that is provided on a second edge opposite the first edge, and wherein the other of the elastic members is provided on a third edge of the opening where no holding portion is provided, and urges the heat dissipating fan so as to abut the fan against a wall member which is provided on a fourth edge opposite the third edge, and is vertical to the surface of the chassis.

3. The fan fastening device according to claim 1, wherein the holding portion is provided in a position to support where the heat dissipating fan housed in the opening of the chassis in such manner that the upper portion of the heat dissipating fan is projected by a predetermined amount from the surface of the chassis, and wherein the holder includes:

a top plate located on the top surface of the housed heat dissipating fan;

a plurality of mounting components which are provided on a pair of opposed edges of the top plate and which each have a wall surface engaging with the outer periphery of the upper portion of the heat dissipating fan projecting upwardly from the surface of the chassis and a mounting member extending perpendicularly from the wall surface and opposing the surface of the chassis; and a plurality of wall members which are provided on another pair of edges arranged at right angles to the pair of edges of the top plate, and each engage with the outer periphery of the upper portion of the heat dissipating fan.

4. The fan fastening device according to claim 1, wherein each of the elastic portions of the holder has a slit opened in a position corresponding to the peripheral portion of the outer casing of the heat dissipating fan housed in the opening of the chassis to thereby form a band-shaped bridge between the slit and the ventilating opening of the holder, and wherein a projection abutting against the top surface of the peripheral portion of the outer casing is provided in the midpoint position of each of the bridges.

* * * * *